US005938468A

United States Patent [19]

Lin

[11] Patent Number: 5,938,468

[45] Date of Patent: Aug. 17, 1999

[54] ELASTIC CLAMP STRUCTURE FOR AN INTERFACE SOCKET

[76] Inventor: Fu-Hsiung Lin, 83, San Ho Road Sec. 4 San Chung City, Taipei Hsien, Taiwan

[21] Appl. No.: 08/897,517

[22] Filed: Jul. 21, 1997

[51] Int. Cl.[6] ..... H01R 13/62

[52] U.S. Cl. ..... 439/372

[58] Field of Search ..... 439/372, 345

[56] References Cited

U.S. PATENT DOCUMENTS 2,643,139 6/1953 Hamilton ..... 439/372

4,556,270 12/1985 Schutzle et al. ..... 439/372

*Primary Examiner*—Steven L. Stephan

*Assistant Examiner*—Brian J. Biggi

*Attorney, Agent, or Firm*—Rosenberg, Klein & Bilker

[57] ABSTRACT

An elastic clamp structure of an interface socket is provided, which consists of an interface socket with two clamps. The clamp has a pressed flat block at each free end, in which the flat block extends out from one side of the cylindrical surface of the wire, while the other side of the flat block maintains the cylindrical surface contour of the wire. The height of the flat block is larger than the inside height of the projecting lug, and smaller than the width of the projecting lug of the interface socket, allowing the clamp to swivel smoothly.

2 Claims, 4 Drawing Sheets

ELASTIC CLAMP STRUCTURE FOR AN INTERFACE SOCKET

BACKGROUND OF THE INVENTION

1. Field of the Invention

The present invention relates to an elastic lamp structure for an interface socket, and more particularly to a clamp structure with a one-sided block frame to prevent the wire clamp of an interface socket from sliding off as the wire clamp is being locked or released.

2. Prior Art

A computer is connected to peripheral equipment by plugging an interface plug into an interface socket. However, that connection can easily fall apart or become disengaged by an external force, causing communications to be interrupted. Therefore, a clamp structure was derived, as shown in FIG. 5 and FIG. 6, which takes advantage of hanging an elastic clamp B made of bent wire on a pair of projecting triangularly-shaped lugs A1 on the interface socket A. The clamps engage the gripping notches C1 formed on the interface plug C, to lock them together as the interface plug C is plugged into the interface socket A. Because the open end of the gripping notch C1 is smaller than the corresponding portion of clamp B, the wire clamp B is pressed into the open gripping notch, the clamp being slid into the gripping notch C1. As a result, both free ends of the wire of the clamp B slide out from the projecting lugs A1 of the interface socket. That results in the interface plug C being free from retaining.

An improved design, shown in FIG. 7 and FIG. 8, has the free ends of the clamp wire B pressed flat to form a flat block B1. The flat block B1 extends between two sides of the wire, at the tip end, for blocking the back side of the projecting lug Al to prevent the end from being withdrawn outwardly. Although that arrangement can solve the problem of unhitching of the clamp B, it creates another problem. As a result of the flat block B1 extending from both sides of the wire, when the clamp B is pivoted on them, one side of the flat block B1 may wedge against the surface of the base plate of the interface socket A to add friction to the rotation of the wire clamp and hinder the operation thereof.

OBJECTS AND SUMMARY OF THE INVENTION

It is therefore a main object of the present invention to provide an elastic clamp with a block frame, which not only prevents the ends of the wire of the clamp withdrawing out, but also allows the clamp to pivot smoothly.

This object is achieved by a one-sided flat block formed at the tip end of the wire of the clamp to block the back side of the projecting lug on the base plate of the interface socket. Even if the clamp is slid into the gripping notch of the interface plug, the clamp cannot be withdrawn by a pulling force. Meanwhile, due to the extension of the flat block from one side of the wire clamp, the clamp can pivot smoothly and freely.

DETAILED DESCRIPTION OF THE PREFERRED EMBODIMENTS

Figure 1:
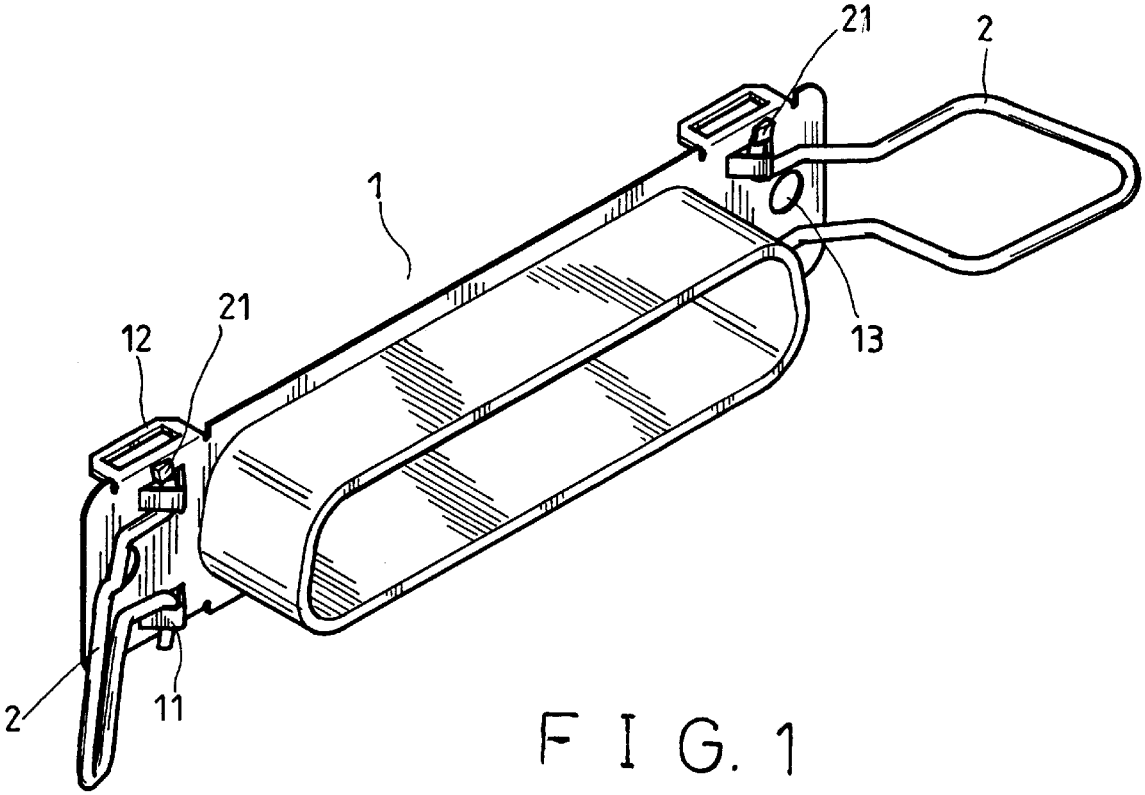
FIG. 1 is a perspective view of the present invention.

Referring to FIG. 1, the present invention includes an interface socket 1 and a clamp 2.

The interface socket 1 has a pair of projecting lugs 11 formed in the base plate adjacent both ends thereof, and a retaining strip 12 bent toward the opposite side of the base plate adjacent the respective edges of the projecting lug 11, and two through-holes 13 respectively formed at both ends.

The clamp 2 is made of a bent wire and has a pressed flat block 21 formed at each free end. Each flat block 21 extends outwardly from one side of the cylindrical surface of the wire, the other side maintains the cylindrical surface contour of the wire. The height of the flat block 21 is greater than the inside height of the projecting lug 11, and smaller than the width of the projecting lug 11 of the interface socket 1.

Figure 2:
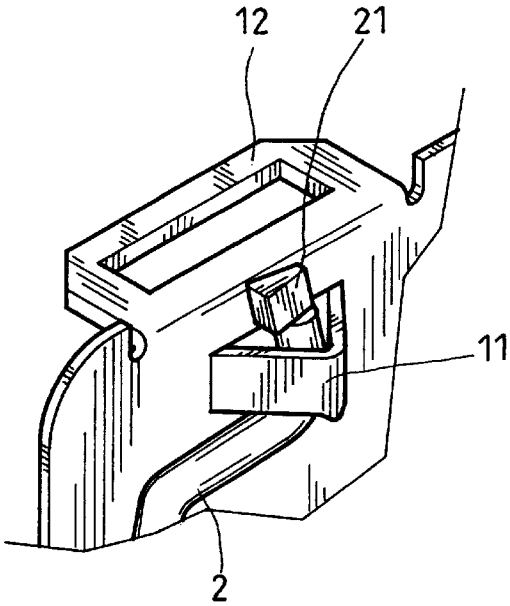
FIG. 2 is an enlarged perspective view of the present invention.
Figure 3:
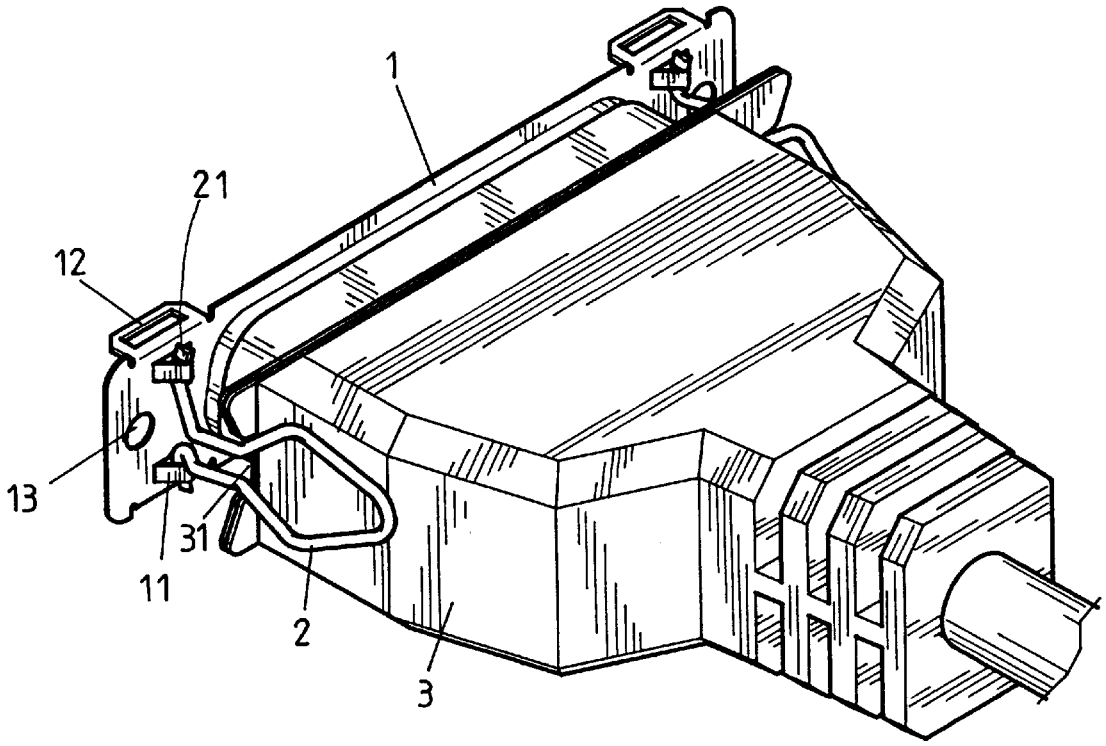
FIG. 3 is a perspective view showing an operation of the present invention.
Figure 4:
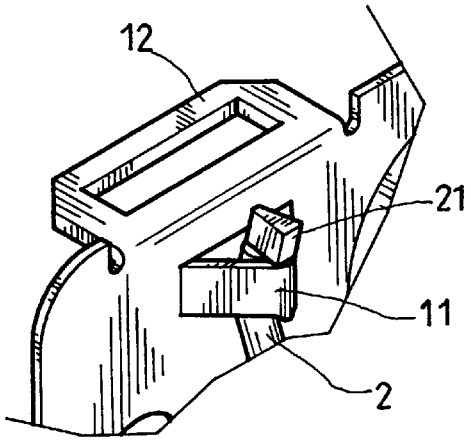
FIG. 4 is an enlarged perspective view showing the operation of the present invention.
Figure 5:
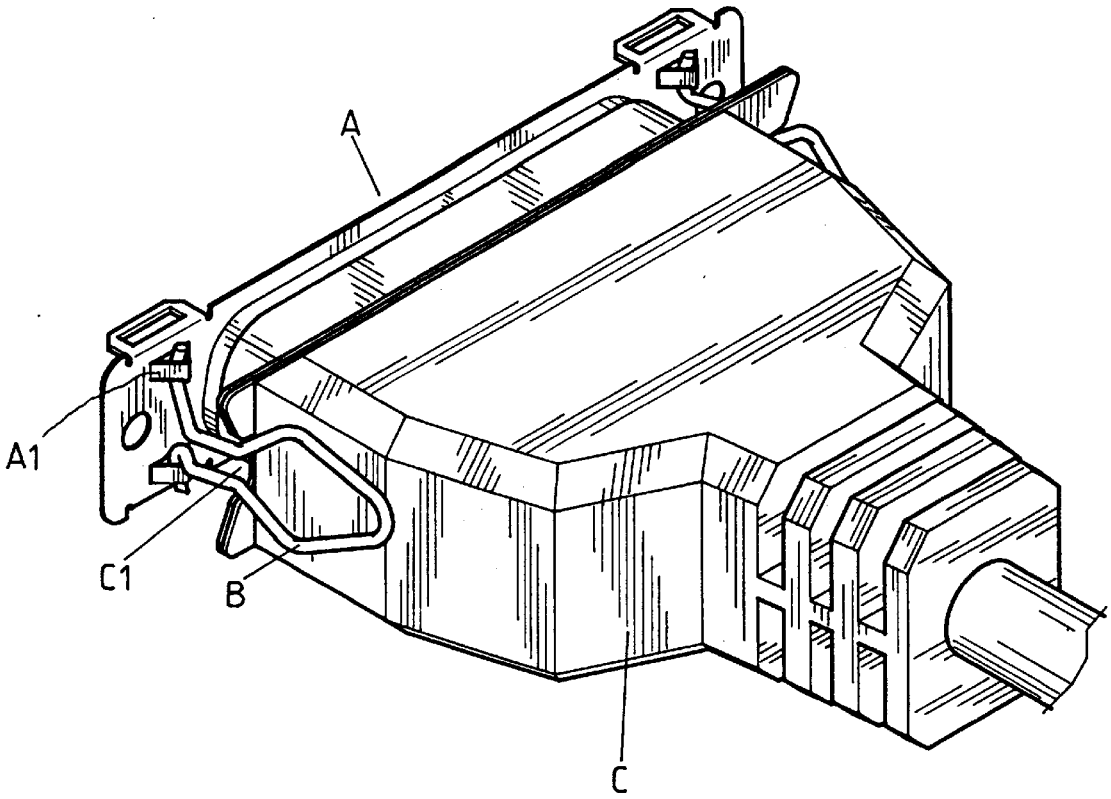
FIG. 5 (PRIOR ART)
FIG. 5 is a perspective view of a first prior art structure.
Figure 6:
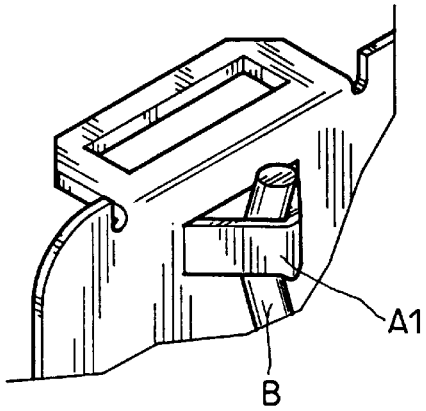
FIG. 6 (PRIOR ART)
FIG. 6 is an enlarged perspective view of the first prior art structure.
Figure 7:
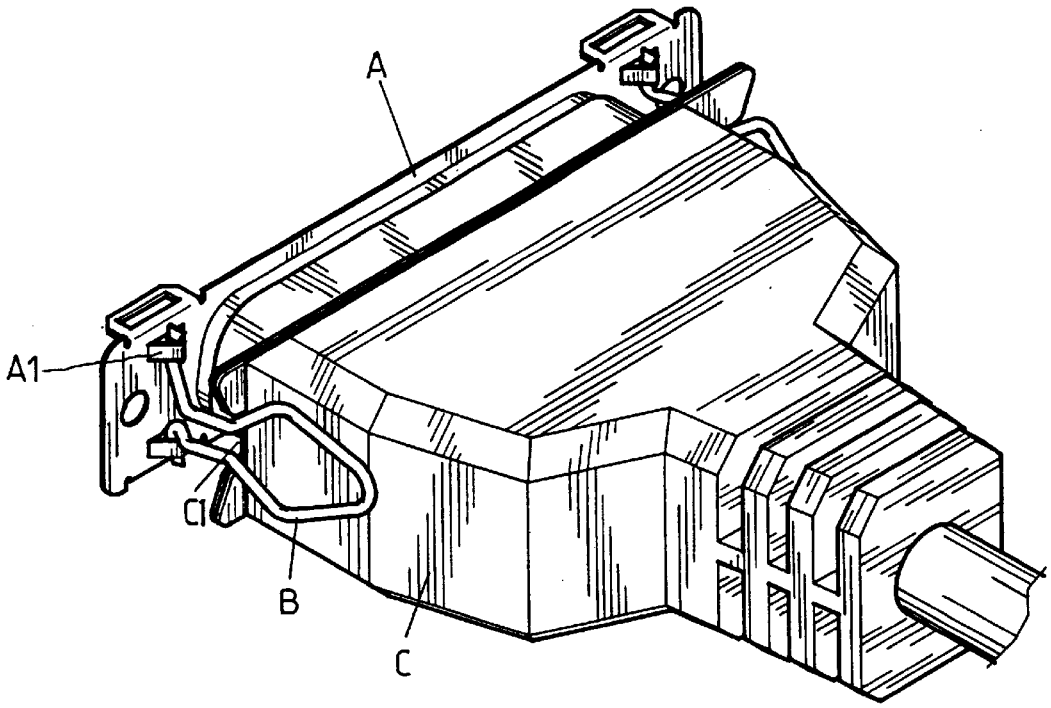
FIG. 7 (PRIOR ART)
FIG. 7 is a perspective view of a second prior art structure.
Figure 8:
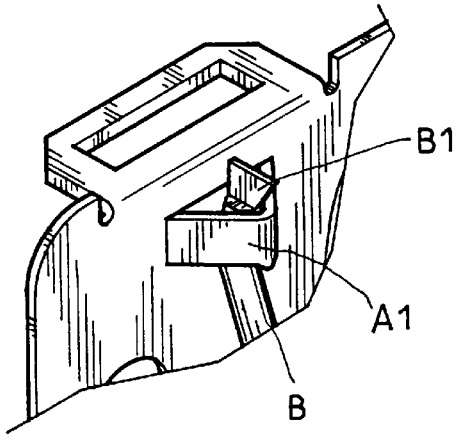
FIG. 8 (PRIOR ART)
FIG. 8 is an enlarged perspective view of the second prior art structure.

The clamp 2 is assembled to the interface socket 1 by plugging the flat blocks 21 into a respective projecting lug 11, with the flat block oriented to pass through the projecting lugs. Referring to FIGS. 2–4, the clamps are mounted on the interface socket 1. When the interface plug 3 is plugged into the interface socket 1, the clamps 2 are rotated so that they catch the gripping notch 31 of the interface plug 3, along the smaller open end of the gripping notch 31. The clamp 2 is pushed into the gripping notch 31. During that process, the wire of the clamp 2 is displaced as it moves into the smaller open end of the gripping notch 31. Owing to the two free ends of each clamp 2 being retained on respective projecting lugs 11 of the interface socket 1 by the flat blocks 21, each clamp 2 is kept in place. The wire of the clamp is restored to its original position as it locks to the inside of the gripping notch 31. Meanwhile the extended side of the flat block 21 is in contact with the outer edge surface of the projecting lug 11, and the cylindrical surface of the opposing side remains in contact with the surfaced of the base plate of the interface socket, allowing the clamp 2 to swivel smoothly without any extra friction. Further, the flat block 21 has a trapezoidally-shaped contour.

I claim:

1. An elastic clamp structure for an interface socket, comprising:

an interface socket having a base plate extending between a pair of longitudinally spaced side portions, each of said side portions having a pair of projecting lugs extending from a front surface of said base plate, each of said projecting lugs defining a through opening of predetermined height and width; and, a pair of clamps formed by a wire bent into a predetermined contour and respectively coupled to said pair of side portions of said base plate, each of said clamps being pivotally coupled to a respective pair of said projecting lugs by passage of a respective end portion of said wire through said through opening of a respective projecting lug for rotative displacement to an operative coupling position, each of said end portions of a respective wire having a flat block formed thereon, said flat block having a first end extending outwardly from a side surface of said wire and an opposing second end in alignment with a respective cylindrical surface of a corresponding side of said wire to prevent blocking rotation of a respective clamp, said first end having an edge surface in contact with a corresponding edge surface of a respective projecting lug when said clamp is in said operative position, said flat block having a length dimension defined by a distance between said first and second ends thereof, said length dimension being greater than said predetermined height of a respective projecting lug and less than said predetermined width thereof.

2. The elastic clamp structure as recited in claim 1 where each said flat block is trapezoidally-shaped, said second end of said flat block being larger than said first end thereof.

* * * * *